US010335747B2

(12) United States Patent
Simmons

(10) Patent No.: US 10,335,747 B2
(45) Date of Patent: Jul. 2, 2019

(54) ADHESIVE-AIR INFUSER DEVICE AND METHOD OF USING THE SAME

(71) Applicant: Simchem Inc., Chapel Hill, NC (US)

(72) Inventor: Raymond Columbus Simmons, Chapel Hill, NC (US)

(73) Assignee: Simchem Inc., Chapel Hill, NC (US)

( * ) Notice: Subject to any disclaimer, the term of this patent is extended or adjusted under 35 U.S.C. 154(b) by 0 days.

(21) Appl. No.: 16/262,203

(22) Filed: Jan. 30, 2019

(65) Prior Publication Data

US 2019/0160441 A1 May 30, 2019

Related U.S. Application Data

(62) Division of application No. 14/945,696, filed on Nov. 19, 2015.

(60) Provisional application No. 62/081,816, filed on Nov. 19, 2014.

(51) Int. Cl.

| | |
|---|---|
| ***B01F 3/04*** | (2006.01) |
| ***B01F 5/04*** | (2006.01) |
| ***B01F 5/06*** | (2006.01) |

(52) U.S. Cl.

CPC ..... *B01F 5/0451* (2013.01); *B01F 3/04262* (2013.01); *B01F 3/04503* (2013.01); *B01F 5/0465* (2013.01); *B01F 5/0615* (2013.01); *B01F 5/0647* (2013.01); *B01F 2215/006* (2013.01)

(58) Field of Classification Search

CPC ..... B01F 3/0462; B01F 3/04262

USPC ..... 366/339; 261/76, 77, 94, 96

See application file for complete search history.

(56) References Cited

U.S. PATENT DOCUMENTS

| | | | | |
|---|---|---|---|---|
| 1,990,803 | A * | 2/1935 | Thompson | A43D 25/183 12/142 F |
| 4,674,888 | A | 6/1987 | Carlson | |
| 2001/0009238 | A1 | 7/2001 | Mosheim et al. | |
| 2004/0207101 | A1 | 10/2004 | Ehrlicher | |
| 2008/0248436 | A1* | 10/2008 | Erhardt | C04B 41/009 432/241 |
| 2012/0042826 | A1* | 2/2012 | Galvin | B05C 5/0279 118/612 |

OTHER PUBLICATIONS

United States Patent and Trademark Office, Office Action for U.S. Appl. No. 14/945,696, dated May 10, 2018, U.S.A.

(Continued)

*Primary Examiner* — David L Sorkin

(74) *Attorney, Agent, or Firm* — Alston & Bird LLP

(57) ABSTRACT

An adhesive-air infuser comprises a hollow body through which adhesive and air flow. The air is directed into the hollow body at an upstream end of the hollow body through an air nozzle positioned within the hollow body, and the adhesive is directed into the hollow body at the upstream end of the hollow body such that the adhesive flows around at least a portion of the air nozzle as the adhesive flows through the hollow body. The adhesive and air are directed by adhesive supply pressure and air supply pressure to flow through the hollow body toward an output port. In various embodiments, adhesive and air flow along a tortuous path that causes the air to mix into the adhesive to form an adhesive-air solution having a density less than the adhesive supplied to the upstream end of the hollow body.

20 Claims, 4 Drawing Sheets

(56) References Cited

OTHER PUBLICATIONS

United States Patent and Trademark Office, Office Action for U.S. Appl. No. 14/945,696, dated Sep. 27, 2018, U.S.A.
United States Patent and Trademark Office, Notice of Allowance for U.S. Appl. No. 14/945,696, dated Jan. 24, 2018, U.S.A.

* cited by examiner

ADHESIVE-AIR INFUSER DEVICE AND METHOD OF USING THE SAME

CROSS-REFERENCE TO RELATED APPLICATIONS

This patent application claims priority to and the benefit of U.S. patent application Ser. No. 14/945,696, filed Nov. 19, 2015; which application also itself claims priority to and the benefit of U.S. provisional patent application Ser. No. 62/081,816, filed Nov. 19, 2014; the contents of both of which as are incorporated herein by reference in their entirety.

BACKGROUND

In various adhesive applications, incorporating air bubbles into a fluid adhesive may create an adhesive assembly having an increased volume without significantly decreasing the effectiveness of the adhesive for a particular intended use. For example, the effectiveness of certain adhesives used in the production of corrugated board is not significantly decreased by incorporating air bubbles into the adhesive to form an adhesive solution. These adhesives form bonds between objects (e.g., paper materials) having similar strengths regardless of whether the adhesive solution does or does not have air bubbles incorporated throughout. Therefore, incorporating air bubbles into an adhesive to form an adhesive solution may provide a cost savings measure by decreasing the amount of the adhesive needed for a particular application.

Historically, heavy machinery having a plurality of moving parts and requiring a significant amount of externally supplied power has been utilized to incorporate air bubbles into adhesive solutions. These machines supply air to a volume of adhesive and utilize one or more rotors to apply shear forces to the adhesive and air to form small air bubbles throughout the adhesive volume and thereby form an adhesive-air solution. However, these machines are often large and include a plurality of moving components necessary to create shear forces within the solution. Therefore, facilities utilizing these machines often must reserve a significant amount of space to store and use these machines. Moreover, because these machines require externally supplied power to operate, generally due to the electrical motors utilized to generate shear forces within the adhesive, the operating costs of these machines make them impractical in small-scale applications.

Therefore, a need exists for an air incorporation system having a small size and requiring low external power requirements that may be used to incorporate air bubbles into adhesive solutions.

BRIEF SUMMARY

An adhesive air infuser for forming an adhesive-air solution. In various embodiments, the adhesive air infuser comprises a hollow body which may comprise one or more rigid tube members, the hollow body defining: an air input port comprising an air nozzle positioned within an interior of the hollow body and through which air flows into the interior of the hollow body, wherein the air input port is positioned at an upstream end of the hollow body; an adhesive input port through which adhesive flows into the interior of the hollow body, wherein the adhesive input port is positioned at the upstream end of the hollow body such that the adhesive flows around at least a portion of the air nozzle while flowing through the hollow body such that the adhesive and the air mix to form an adhesive-air solution while flowing through the hollow body; and a solution exit port through which an adhesive-air solution flows out of the interior of the hollow body, wherein the solution exit port is positioned at a downstream end of the hollow body. In various embodiments, the hollow body is air-tight.

In various embodiments, the air nozzle defines a plurality of entry openings through which the air flows into the interior of the hollow body such that the air flows into the interior of the hollow body to form air bubbles within the adhesive flowing around the air nozzle. The air openings may have a maximum hydraulic diameter of about 20 microns. In various embodiments, the air nozzle comprises an air diffuser.

Moreover, in various embodiments, the adhesive air infuser additionally comprises an inline mixer, such as a static inline mixer, positioned within the interior of the hollow body between the upstream end and the downstream end of the hollow body, wherein the inline mixer defines a tortuous fluid travel path configured to mix the adhesive and the air to form an adhesive-air solution as the adhesive and air flow through the hollow body. In various embodiments, the cross section of the inline mixer is substantially the same as the cross section of the interior of the hollow body such that substantially all of the adhesive and air are directed through the inline mixer while flowing from the upstream end to the downstream end.

Moreover, in various embodiments, the air input port comprises an air pressure gauge and/or an air pressure adjustment valve. In various embodiments, the hollow body is configured to continuously receive air through the air input port to form an air entrance pressure and to continuously receive adhesive through the adhesive input port to form an adhesive entrance pressure, and wherein the air entrance pressure and the adhesive entrance pressure move the adhesive and the air through the hollow body. In various embodiments, the air entrance pressure is greater than the adhesive entrance pressure.

Various embodiments are directed to a method of infusing air into an adhesive. The method may comprise steps for: directing a flow of air through an air nozzle and into an interior of a hollow body at an upstream end of the hollow body; directing a flow of adhesive into the interior of the hollow body and around at least a portion of the air nozzle at the upstream end of the hollow body; causing the adhesive and the air to flow from the upstream end of the hollow body toward a downstream end of the hollow body such that the adhesive and the air mix to form an adhesive-air solution while flowing through the hollow body; and directing the adhesive-air solution out of the interior of the hollow body at the downstream end of the hollow body.

In various embodiments, the air nozzle comprises an air diffuser defining a plurality of entry openings, which may have a maximum hydraulic diameter of about 20 microns, through which the air flows into the interior of the hollow body such that the air flows into the interior of the hollow body to form air bubbles within the adhesive flowing around the air diffuser.

In various embodiments, causing the adhesive and the air to flow from the upstream end of the hollow body toward a downstream end of the hollow body comprises causing the adhesive and the air to flow along a tortuous path that causes the air to be absorbed into the adhesive to form the adhesive-air solution. Moreover, in various embodiments, the flow of air is directed through the air nozzle at an air pressure and the flow of adhesive is directed into the interior of the hollow body at an adhesive pressure, and wherein the air pressure is greater than the adhesive pressure. In various embodiments, the air pressure and the adhesive pressure cause the adhesive and the air to flow from the upstream end of the hollow body toward the downstream end of the hollow body. Moreover, in various embodiments, the flow of air is controlled by a computer controller configured to control an air input pressure to the hollow body.

BRIEF DESCRIPTION OF THE SEVERAL VIEWS OF THE FIGURES

Reference will now be made to the accompanying figures, which are not necessarily drawn to scale, and wherein.

DETAILED DESCRIPTION

Figure 1:
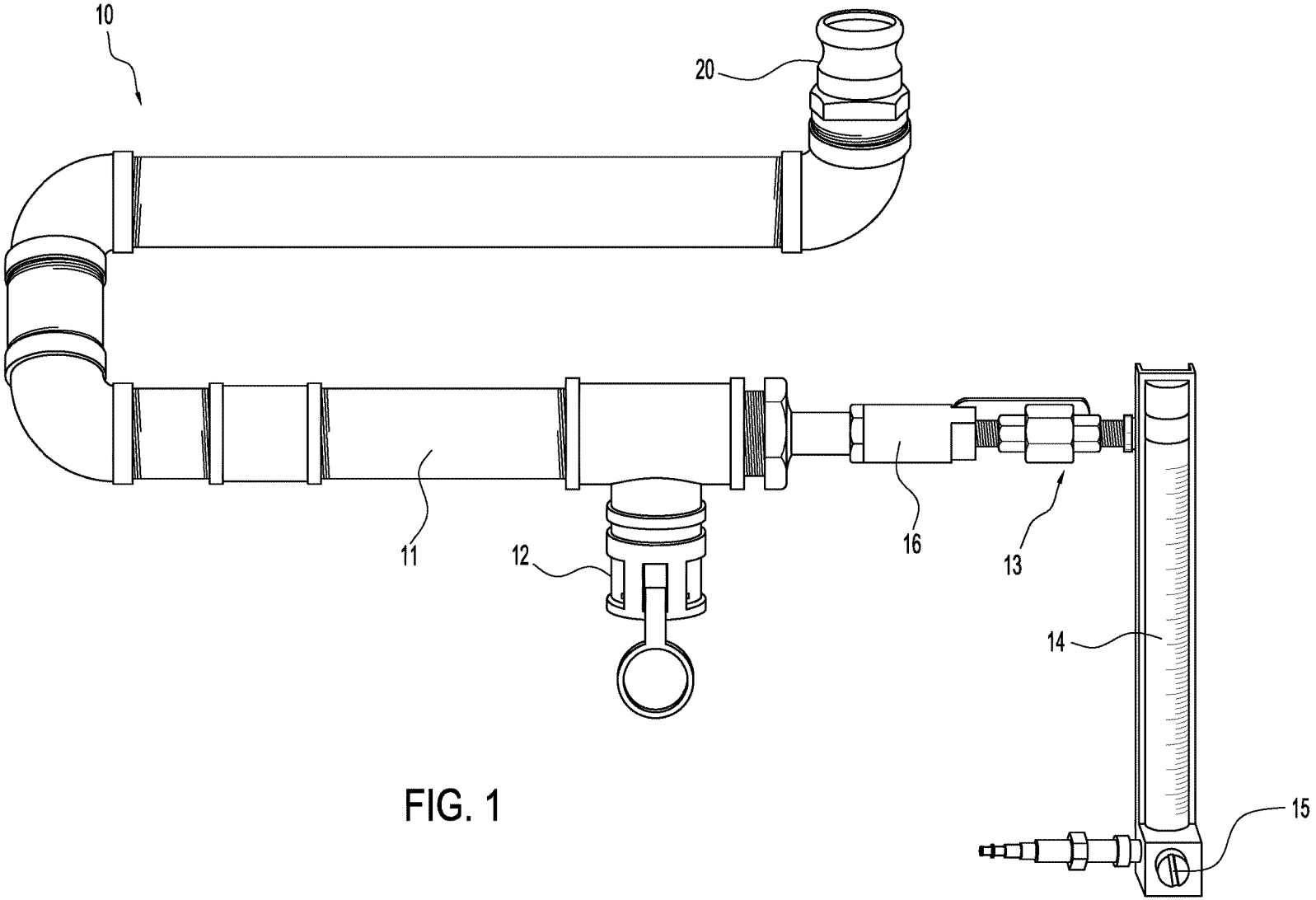
FIG. 1 illustrates an assembled air infuser according to one embodiment.

The present invention will now be described more fully hereinafter with reference to the accompanying figures, in which some, but not all embodiments of the invention are shown. Indeed, the invention may be embodied in many different forms and should not be construed as limited to the embodiments set forth herein. Rather, these embodiments are provided so that this disclosure will satisfy applicable legal requirements. Like numbers refer to like elements throughout.

Overview

Various embodiments of the present invention are directed to an air infuser device for incorporating air into an adhesive (e.g., a water-based adhesive) to form an adhesive solution. Although this description describes an input to the device as air, it should be understood that any gas may be utilized as an input for the system (e.g., carbon dioxide, oxygen, nitrogen, and/or the like). For example, air may be incorporated into a water-based adhesive such as a starch corrugating adhesive or a vinyl acetate adhesive. In various embodiments, the air infuser comprises one or more rigid tubing members collectively having an adhesive input port, an air input assembly, and a solution output port. The air input assembly comprises an air diffuser positioned within a portion of the rigid tubing members having a plurality of entry openings allowing air to enter an interior of the rigid tubing members directly into adhesive flowing around the diffuser such that the air enters the adhesive as small air bubbles formed within the adhesive flowing around the diffuser. In various embodiments, the adhesive input port is configured to accept the solution into the interior of the rigid tubing members at a position such that the adhesive flows around at least a portion of the air diffuser before advancing toward the solution exit.

In various embodiments, the air infuser additionally comprises an inline mixer positioned between the inputs (the adhesive input port and the air input assembly), and the solution output port. The inline mixer is configured to mix the air that entered the interior of the rigid tubing members as bubbles and the adhesive before the mixed solution exits the air infuser device. However, in various embodiments, the small bubbles formed in the adhesive while the air is being directed through the air diffuser may be sufficiently mixed throughout the adhesive while the adhesive travels through the rigid tubing members without an inline mixer positioned therein, and accordingly various embodiments may not comprise an inline mixer.

The air infuser is configured to incorporate air into an adhesive and thereby generate an adhesive solution having a lower density than the input adhesive. The resulting adhesive solution includes a plurality of air bubbles incorporated throughout the solution, and therefore the solution has a decreased density compared to the solution entering the device at the adhesive input port. The air bubbles are incorporated into the adhesive solution such that the bubbles remain in solution while the adhesive sets into a final, solid state.

Air Infuser

FIG. 1 illustrates an air infuser according to one embodiment of the present invention. In various embodiments, the air infuser 10 comprises a hollow body portion which, as shown in the illustrated embodiment of FIG. 1, may comprise one or more rigid tubing members 11, such as stainless steel pipe and stainless steel pipe fittings, although other materials and types of rigid tubing members are also contemplated (e.g., plastic, brass, aluminum, and/or the like). In various embodiments, the rigid tubing members 11 have an interior diameter of at least substantially 1½," although other diameters, such as at least substantially ½" (as a non-limiting example), are also contemplated. Moreover, in various embodiments, the hollow body may be fluid-tight (i.e., sealed), such that one or more fluids (e.g., adhesive and/or air) may not leak through the walls of the hollow body. As will be described in greater detail herein, fluids may be directed through respective input ports (e.g., an adhesive input port and an air input port) into the hollow body, and may be directed out of the hollow body by a single solution output port.

Figure 2:
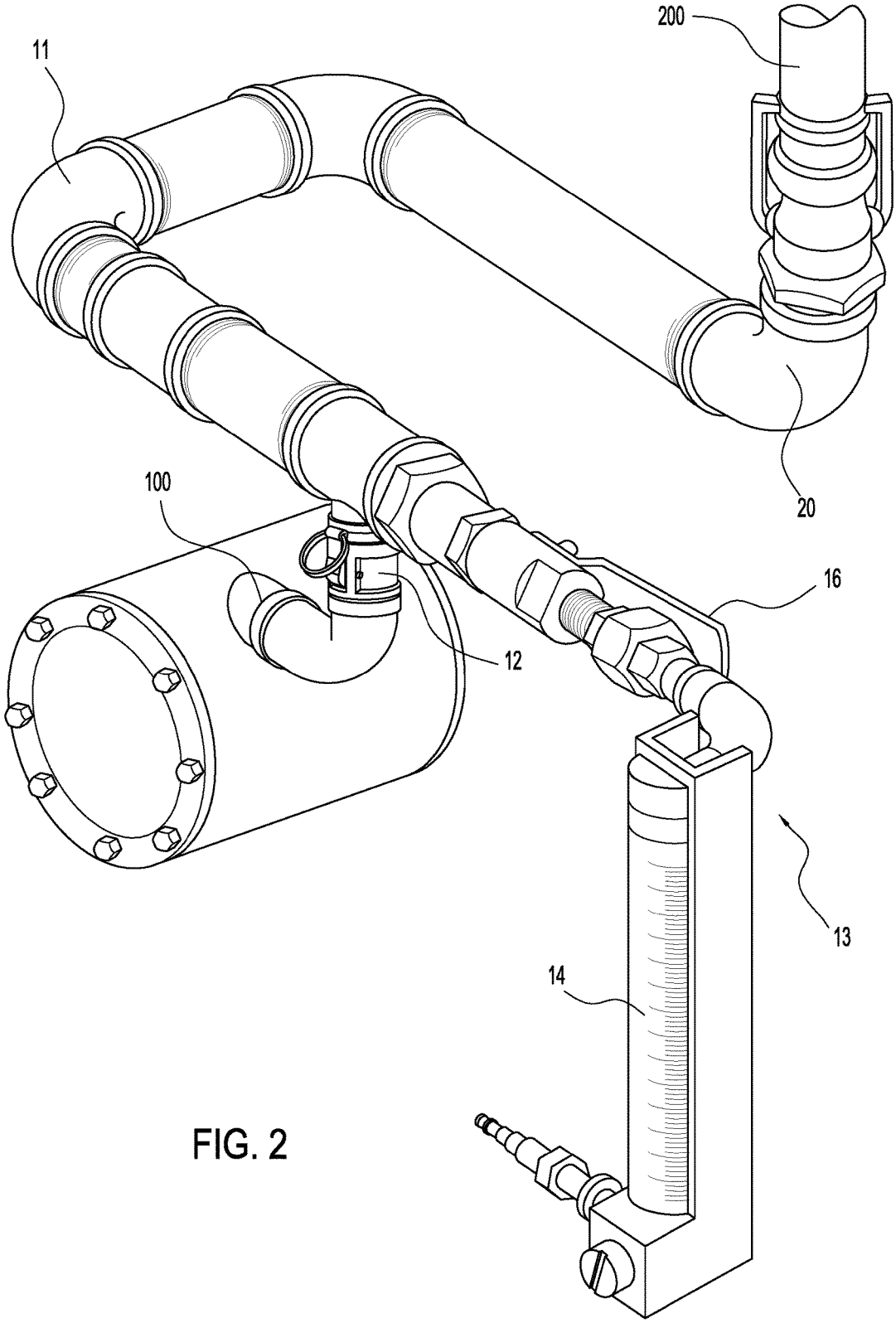
FIG. 2 illustrates an assembled air infuser installed in an operating environment, according to one embodiment.
Figure 4:
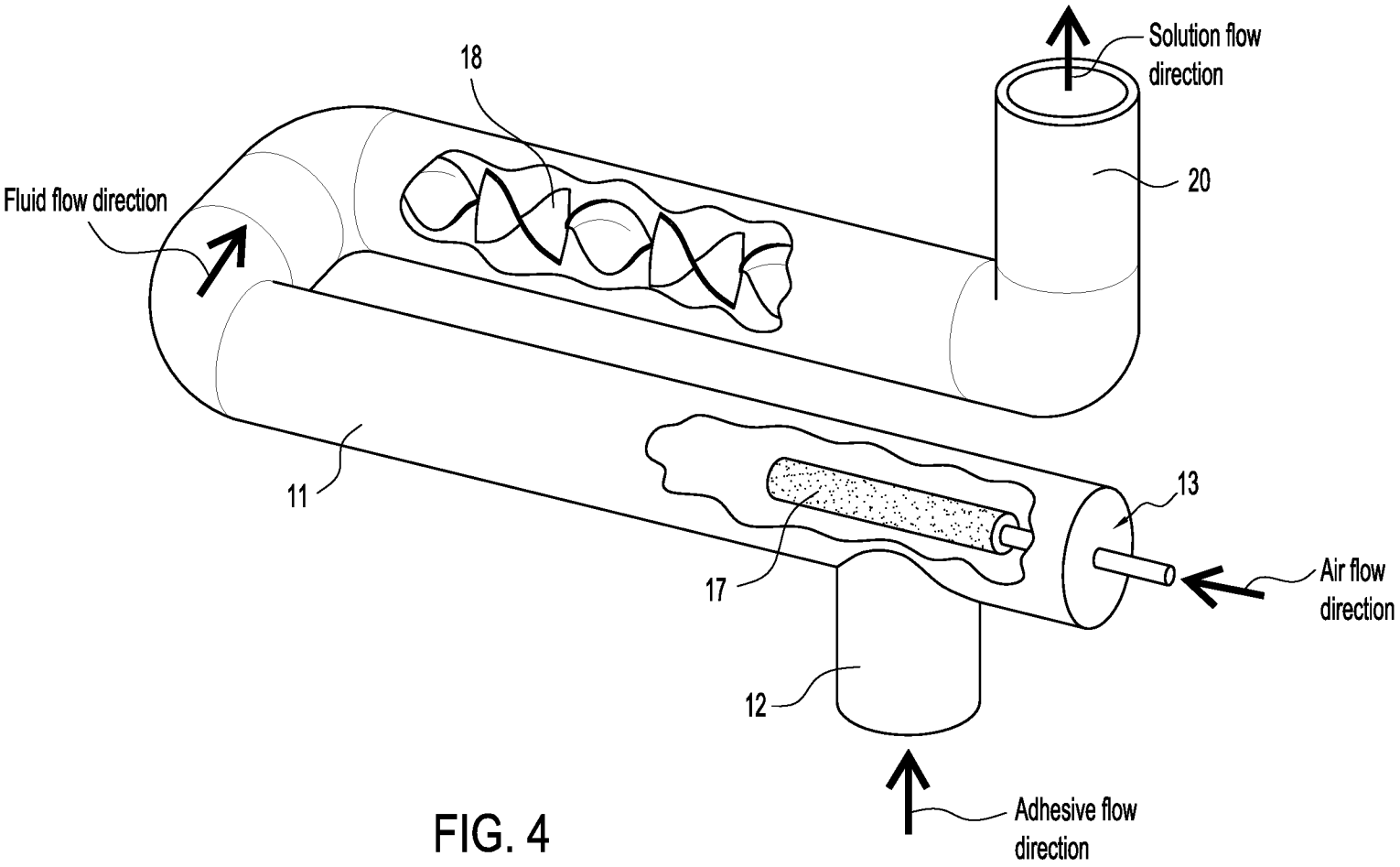
FIG. 4 is a schematic diagram of an assembled air infuser illustrating the orientation of interior components of the air infuser.

The hollow body defines an upstream end at which fluids (e.g., adhesive and air) enter the hollow body, and a downstream end at which the solution exits the hollow body. In various embodiments, the rigid tubing members 11 may be arranged in any of a plurality of orientations. For example, as will be shown and described in the following figures, the rigid tubing members 11 may be oriented in a substantially "U" shape (as illustrated in FIGS. 2 and 4) such that the air infuser 10 has a compact overall size. In such embodiments, the upstream end may be on the end of one "leg" of the "U" shape, and the downstream end may be on the end of the opposite "leg" of the "U" shape, such that a fluid travel path through the rigid tubing members 11 moves from the end of the first leg, down the leg, through the central portion of the "U" and through the second leg of the "U" to the downstream end.

As shown in FIG. 1, the adhesive input port 12 and solution output port 20 may comprise a quick-release connector for quickly connecting a supply line 100 or outlet line 200 (as shown in FIG. 2) to the respective input port and output port. Moreover, one of the adhesive input port 12 and the solution output port 20 may comprise a female quick release connection (e.g., the adhesive input port 12 as shown in FIG. 1) and one of the adhesive input port and the solution output port may comprise a male quick release connection (e.g., the solution output port 20, as shown in FIG. 1) so as to impede connection of the improper supply line 100 and/or output line 200 to the air infuser 10.

As shown in FIG. 1, air input assembly 13 may comprise a pressure gauge 14 configured to indicate the input pressure of the air. In various embodiments, the pressure gauge 14 may additionally comprise a user control 15 (e.g., as a non-limiting example, a knob) to allow a user of the air infuser 10 to manually adjust the air input pressure at the air input assembly. Moreover, the air input assembly 13 may comprise an on/off valve 16 (e.g., as a non-limiting example, a ball valve). In various embodiments, the air input assembly 13 may be at least in part computer-controlled. For example, the air input pressure may be controlled by a computerized controller configured to ensure that the air input pressure is sufficient to provide an adhesive solution having a predetermined density. For example, the computerized controller may be configured to change the air input pressure in order to change the density of the resulting adhesive solution provided by the air infuser 10. For example, increasing the air input pressure may result in an adhesive-air solution having a decreased density. In various embodiments, the computer controller may be configured to determine an optimal air input pressure to provide a user-selected adhesive-air solution density.

FIG. 2 illustrates an exemplary air infuser 10 installed in an operational environment according to one embodiment of the present invention. In the illustrated embodiment of FIG. 2, the air infuser 10 may be installed and operated near an adhesive source (not shown) that supplies an adhesive solution into the adhesive input port 12 of the air infuser 10 via an adhesive supply line 100. Moreover, as described in detail herein, the air infuser 10 receives air from an air source (not shown) via the air input assembly 13 of the air infuser 10. The fluids (air and adhesive) advance through the air infuser 10 and are mixed together to form an adhesive solution having a lower density before exiting the air infuser 10 through the solution output port 20.

Figure 3:
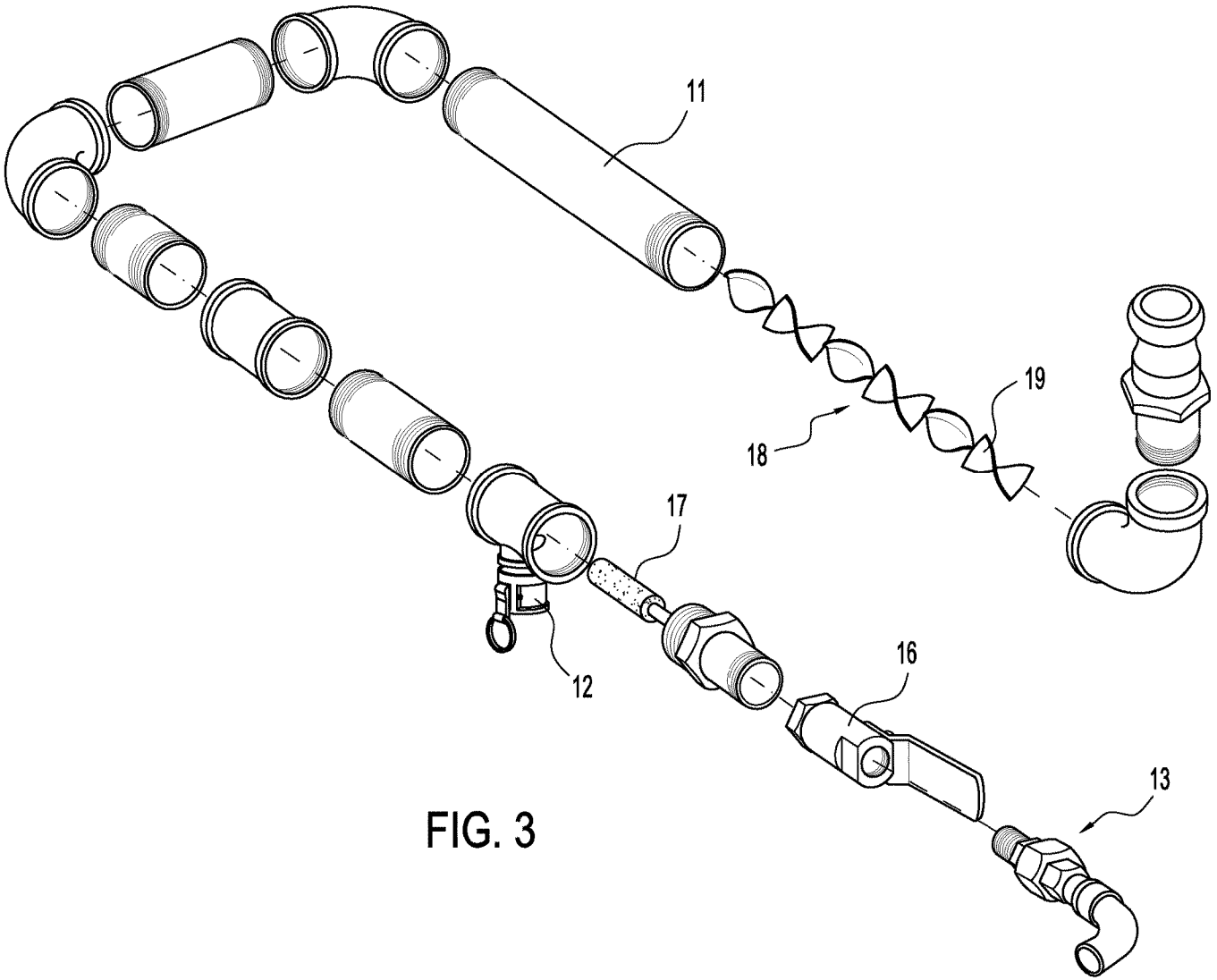
FIG. 3 illustrates a disassembled air infuser according to one embodiment.

FIG. 3 illustrates the components of an exemplary air infuser 10 according to one embodiment of the present invention. As shown in FIG. 3, the air input assembly 13 comprises an air nozzle positioned within the rigid tubing members 11 through which air flows into the interior of the rigid tubing members 11 from the air input assembly 13. In the illustrated embodiment of FIG. 3, the air nozzle comprises an air diffuser 17 positioned within the rigid tubing members 11 when assembled. The air diffuser 17 comprises a plurality of entry openings configured to direct the air into the interior of the rigid tubing members 11 such that the air forms small air bubbles in adhesive surrounding (e.g., flowing around) the diffuser. In various embodiments, the entry openings have a maximum hydraulic diameter of at least substantially 20 microns. For example, the SD-12: 12-in Stainless Steel Diffuser, by Ozone Solutions, Inc. of Hull, Iowa may be used to direct air into the interior of the rigid tubing members 11. Of course, alternative hydraulic diameters may be utilized, as desirable. Still further, although the example diffuser comprises a stainless-steel material, other materials are also contemplated (e.g., aluminum, ceramic, and/or the like).

Moreover, as shown in FIG. 3, the air infuser 10 may comprise an inline mixer 18 configured to mix the air and the adhesive to create an adhesive solution having a lower density than the adhesive entering the air infuser 10 through the adhesive input port 12. In the illustrated embodiment of FIG. 3, the inline mixer 18 comprises a static mixer configured to mix one or more fluids (e.g., air and adhesive) by directing the one or more fluids through a tortuous path causing the fluids to undergo turbulence to mix the one or more fluids. For example, in the illustrated embodiment of FIG. 3, the inline mixer 18 may comprise a plurality of contoured elements 19 configured to direct the fluids to alternatingly rotate in a clockwise and counter-clockwise direction while advancing through the air infuser 10. In various embodiments, each of the plurality of contoured elements 19 may comprise helical-shaped plates rotated between opposing ends. As a non-limiting example, each contoured element 19 may rotate 90 degrees between a first end and a second end. Moreover, as shown in FIG. 3, a plurality of contoured elements may be secured relative to one another to create an elongated tortuous path. As shown in FIG. 3, adjacent ends of adjacent contoured elements 19 may be secured at an angle relative to one another. For example, as shown in FIG. 3, each contoured element 19 may be fixedly secured at a 90 degree angle relative to adjacent contoured elements 19. Moreover, as shown in FIG. 3, each contoured element 19 may comprise a generally rectangular element that has been twisted to form the helical-shape. However, any of a variety of shapes may be utilized, including triangular, diamond-shaped, and/or the like. The contoured elements 19 cause the adhesive solution and the air to be further mixed together as the adhesive solution and air advance through the rigid tubing members 11 without requiring externally supplied power. Instead, the adhesive input pressure and the air input pressure, which collectively causes the fluids to advance through the air infuser 10, causes the fluids to be mixed by the inline mixer 18. As shown in FIGS. 3 and 4, the inline mixer 18 may have a cross sectional size substantially the same as the interior cross-section of the rigid tubing members 11, such that substantially all of the fluid moving through the rigid tubing members 11 is directed through the contoured elements 19.

In various embodiments, the inline mixer 18 may comprise a plurality of stainless-steel contoured elements 19, although other materials are also contemplated (e.g., plastic, aluminum, and/or the like). Moreover, the diameter of the contoured elements 19 may be sized such that the inline mixer 18 resides within the assembled air infuser 10 with minimal clearance between the interior walls of the rigid tubing members 11 and the contoured elements 19, such that substantially all of the adhesive and air is directed through the contoured elements 19. In various embodiments, the inline mixer 18 may be secured within the rigid tubing members 11 such that the inline mixer 18 may be prevented from rotating and/or sliding within the rigid tubing members 11. However, in various embodiments, the inline mixer 18 may be slidably and/or rotatably positioned within the rigid tubing members 11 such that the inline mixer 18 may slide and/or rotate within the rigid tubing members 11. Moreover, although not shown, a plurality of inline mixers 18 may be provided within the rigid tubing members 11. For example, the plurality of inline mixers 18 may be positioned in series within the rigid tubing members 11 such that one or more fluids (e.g., adhesive and air) flows through a first inline mixer 18 and then flows through a second inline mixer 18. In various embodiments, the plurality of inline mixers 18 may be provided in parallel, such that a plurality of inline mixers are positioned at least partially adjacent, such that one or more fluids flow along at least a portion of the length of the plurality of inline mixers simultaneously.

In various embodiments, the inline mixer 18 may be located along a portion of the fluid travel path between the upstream end and the downstream end of the rigid tubing members 11. As a non-limiting example, in "U"-shaped embodiments as shown in FIGS. 1-2, the inline mixer 18 may be within one or more straight portions of the rigid tube members 11. For example, the inline mixer 18 may be positioned within the downstream leg of the "U" shaped inline mixer 18.

Moreover, although not shown, in various embodiments the inline mixer 18 may be configured to rotate within the rigid tubing members 11 in order to facilitate further mixing of the one or more fluids (e.g., adhesive and air). The inline mixer 18 may be configured to rotate as a result of the one or more fluids flowing along the length of the inline mixer 18 and/or in accordance with a power source (e.g., a motor). In various embodiments, the inline mixer 18 may be configured to rotate about an axis concentric with the inline mixer 18, or may be configured to rotate about an axis parallel to the direction of fluid travel and offset from a concentric axis of the inline mixer 18.

In various embodiments, the air infuser 10 may not include an inline mixer 18, and accordingly the air infuser 10 may provide for sufficient mixing of the air bubbles formed by the input of air through the diffuser into the flowing adhesive without the inline mixer 18.

FIG. 4 is a schematic diagram of an air infuser 10 according to one embodiment of the present invention having portions of the rigid tubing members 11 cut away to show the interior of the air infuser 10. As shown in FIG. 4, the air diffuser 17 is positioned within the rigid tubing members 11 such that at least a portion of the air diffuser 17 extends beyond the adhesive input port 12 such that the adhesive flows around at least a portion of the air diffuser 17 before advancing through the air infuser 10. As discussed herein, as the adhesive flows around the air diffuser 17, the air may enter the adhesive through the air diffuser 17 to form small bubbles in the adhesive. As the adhesive flows through the air infuser 10 with the small air bubbles formed therein, the air bubbles may become mixed (e.g., distributed) throughout the adhesive to lower the overall density of the adhesive-air solution. In various embodiments, as shown in FIG. 4, an inline mixer 18 may be located downstream of the inputs (the adhesive input port 12 and the air input assembly 13), such that the input fluids are mixed over the entire length of the inline mixer 18.

As shown in FIGS. 1-3, the rigid tubing members 11 may comprise a plurality of stainless steel pipe members and fittings configured to be threaded together. For example, each of the plurality of stainless steel pipe members may comprise male threads located on each end of the pipe member that are configured to interlock with female threads located on the interior of each pipe fitting. In various embodiments, the plurality of rigid tubing members are configured to be coupled together such that the fluids within the air infuser 10 (e.g., adhesive and air) are prevented from escaping through the interfaces between rigid tubing members 11 without additional sealing members (e.g., O-rings, gaskets, and/or the like). Various components of the air infuser 10 may additionally be coupled together with a plurality of alternative fasteners (e.g., welding or the like). For example, as shown in FIGS. 2 and 3, at least a portion of the air input assembly 13 components are welded together to prevent the fluids (e.g., air) from escaping through the interface between air input assembly 13 components.

Various embodiments of the air infuser 10 may be selectively disassembled for cleaning and component replacement. For example, in embodiments comprising a plurality of stainless steel pipe components coupled to a plurality of pipe fittings using threaded connections, each of the components may be unscrewed from one another to disassemble the air infuser 10.

Method of Use

In various embodiments, an adhesive solution may be created by supplying an air infuser 10 with an adhesive and air in order to create a final adhesive solution having a lower density than the originally supplied adhesive.

In various embodiments, the adhesive is supplied to the air infuser 10 through the adhesive input port 12. For example, the adhesive may be supplied via external tubing (e.g., a supply line 100 as shown in FIG. 2). The adhesive is supplied to the air infuser 10 at a pressure at least high enough to advance the adhesive through the entire air infuser 10. Thus, the adhesive is supplied at an adhesive input pressure greater than the pressure drop applied to the solution by the walls of the rigid tubing members 11 and an inline mixer 18 (if present). The adhesive flows through the adhesive input port 12 and around at least a portion of the air diffuser 17 before advancing through the air infuser 10. Air is supplied to the air infuser 10 via the air input assembly 13, which may be controlled by a computer controller system configured to control the air input pressure to the air infuser 10. In various embodiments, the air input pressure may be adjusted to accommodate a desired adhesive-air solution density. The air flows through the air input assembly 13, through the plurality of openings in the air diffuser 17, and into the interior of the rigid tubing members 11 to form small air bubbles in the adhesive flowing around the air diffuser 17. At least a portion of the air entering the interior of the rigid tubing members 11 is entrapped in a plurality of bubbles within the adhesive flowing around at least a portion of the air diffuser 17. In various embodiments, the air input pressure is greater than the adhesive input pressure in order to ensure that at least a predetermined minimum amount of air is added to the adhesive in order to generate a final adhesive solution having substantially a predetermined density. After the fluids (e.g., adhesive and air) are supplied to the air infuser 10, the fluids advance through the length of the air infuser 10 and, in various embodiments, flow through an inline mixer 18 located downstream of the inputs (e.g., the adhesive input port 12 and the air input assembly 13). The adhesive input pressure and the air input pressure advances the fluids through the inline mixer 18 without additional external power supplied to the air infuser 10. However, in various embodiments, the inline mixer 18 may be provided with a power source (e.g., a motor) to rotate the inline mixer 18 in order to further mix the adhesive and air. As the fluids advance through the plurality of contoured elements 19 in the inline mixer 18, the fluids are mixed to create a substantially uniform distribution of air bubbles throughout the adhesive solution. The resulting combined adhesive-air solution is an adhesive-air solution having a lower density than the adhesive supplied to the adhesive input port of the air infuser 10. As a non-limiting example, the resulting adhesive-air solution may comprise 18% air by volume. As noted herein, the density of the adhesive-air solution may be modified at least in part by changing the air input pressure supplying air to the air infuser 10. By changing the air input pressure relative to the adhesive supply pressure, the density of the resulting adhesive-air solution may be modified. Thus, a decreased amount of adhesive (as supplied to the adhesive input port) may be utilized for a similar application for adhering various products, surfaces, and/or the like.

In various embodiments, the air infuser 10 may be cleaned by disassembling the air infuser 10 and individually cleaning each of the plurality of components (e.g., by removing the diffuser 17, the inline mixer 18, and/or the like from the rigid tubing members 11), or it may be cleaned by supplying a cleaning fluid (e.g., water) to the air infuser 10 through the adhesive input port 12 and/or the air input assembly 13.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the disclosure. Although specific terms are employed herein, they are used in a generic and descriptive sense only and not for purposes of limitation.

That which is claimed:

1. A method of infusing air into an adhesive, the method comprising steps for:

directing a flow of air through an air nozzle and into an interior of a hollow body at an upstream end of the hollow body;

directing a flow of adhesive into the interior of the hollow body and around at least a portion of the air nozzle at the upstream end of the hollow body;

causing the adhesive and the air to flow from the upstream end of the hollow body toward a downstream end of the hollow body such that the adhesive and the air mix to form an adhesive-air solution while flowing through the hollow body; and directing the adhesive-air solution out of the interior of the hollow body at the downstream end of the hollow body, wherein the air nozzle comprises an air diffuser defining a plurality of entry openings through which the air flows into the interior of the hollow body such that the air flows into the interior of the hollow body to form air bubbles within the adhesive flowing around the air diffuser.

2. The method of claim 1, wherein the entry openings have a maximum hydraulic diameter of about 20 microns.

3. The method of claim 1, wherein:

the air nozzle has a longitudinal axis aligned with a longitudinal axis of a portion of the hollow body adjacent the air nozzle;

an adhesive input port, through which the flow of adhesive enters the interior of the hollow body, is oriented perpendicular to the longitudinal axis of the portion of the hollow body adjacent the air nozzle; and at least one portion of the air nozzle is positioned within the hollow body downstream relative to the adhesive input port.

4. The method of claim 3, wherein:

the hollow body comprises a first leg portion connected to the adhesive input port and a second leg portion connected to a solution exit port; and the second leg portion is parallel to the first leg portion, such that the adhesive-air solution flowing through the first leg portion flows in an opposite direction from that of the adhesive-air solution flowing through the second leg portion.

5. The method of claim 4, wherein:

an inline mixer is positioned within an interior of the second leg portion of the hollow body between the upstream end and the downstream end of the hollow body; and the inline mixer defines a tortuous fluid travel path configured to mix the adhesive and the air to form an adhesive-air solution as the adhesive and air flow through the hollow body.

6. The method of claim 5, wherein the cross section of the inline mixer is substantially the same as the cross section of the interior of the hollow body such that substantially all of the adhesive and air are directed through the inline mixer while flowing from the upstream end to the downstream end.

7. The method of claim 5, wherein the inline mixer is configured to rotate about an axis concentric with an axis of the inline mixer.

8. The method of claim 5, wherein the inline mixer is configured to rotate about an axis parallel to the direction of fluid travel and offset from a concentric axis of the inline mixer.

9. The method of claim 5, wherein the inline mixer is spaced a distance apart and downstream from an air input port.

10. The method of claim 9, wherein the inline mixer is also rotationally fixed.

11. The method of claim 5, wherein:

the inline mixer comprises a plurality of contoured elements configured to direct the fluids to alternatingly rotate in a clockwise and counter-clockwise direction while advancing through the air diffuser; and each of the plurality of contoured elements comprise helical-shaped plates rotated between opposing ends.

12. The method of claim 4, wherein the hollow body further comprises a central portion intermediate both the first leg portion and the second leg portion, the central portion being oriented perpendicular to both the first leg portion and the second leg portion, such that the hollow body is substantially "U" shaped.

13. The method of claim 1, wherein causing the adhesive and the air to flow from the upstream end of the hollow body toward a downstream end of the hollow body comprises causing the adhesive and the air to flow along a tortuous path that causes the air to be absorbed into the adhesive to form the adhesive-air solution.

14. The method of claim 1, wherein the flow of air is directed through the air nozzle at an air pressure and the flow of adhesive is directed into the interior of the hollow body at an adhesive pressure, and wherein the air pressure is greater than the adhesive pressure.

15. The method of claim 14, wherein the air pressure and the adhesive pressure cause the adhesive and the air to flow from the upstream end of the hollow body toward the downstream end of the hollow body.

16. The method of claim 1, wherein the flow of air is controlled by a computer controller configured to control an air input pressure to the hollow body.

17. The method of claim 1, wherein the hollow body is configured to continuously receive air through an air input port to form an air entrance pressure and to continuously receive adhesive through an adhesive input port to form an adhesive entrance pressure, and wherein the air entrance pressure and the adhesive entrance pressure move the adhesive and the air through the hollow body.

18. The method of claim 17, wherein the air entrance pressure is greater than the adhesive entrance pressure.

19. The method of claim 1, wherein the hollow body comprises one or more rigid tube members.

20. A method of infusing air into an adhesive, the method comprising steps for:

directing a flow of air through an air nozzle and into an interior of a hollow body at an upstream end of the hollow body;

directing a flow of adhesive into the interior of the hollow body and around at least a portion of the air nozzle at the upstream end of the hollow body;

causing the adhesive and the air to flow from the upstream end of the hollow body toward a downstream end of the hollow body such that the adhesive and the air mix to form an adhesive-air solution while flowing through the hollow body; and directing the adhesive-air solution out of the interior of the hollow body at the downstream end of the hollow body, wherein:

the air nozzle: (1) defines a plurality of entry openings through which the air flows into the interior of the hollow body; and (2) has a longitudinal axis aligned with a longitudinal axis of a portion of the hollow body adjacent the air nozzle;

an adhesive input port, through which the flow of adhesive enters the interior of the hollow body, is oriented perpendicular to the longitudinal axis of the portion of the hollow body adjacent the air nozzle; and at least one portion of the air nozzle is positioned within the hollow body downstream relative to the adhesive input port.

* * * * *